US011156071B2

(12) United States Patent
Chang et al.

(10) Patent No.: US 11,156,071 B2
(45) Date of Patent: Oct. 26, 2021

(54) METHOD OF SUBTERRANEAN FRACTURING

(71) Applicant: Saudi Arabian Oil Company, Dhahran (SA)

(72) Inventors: Fakuen Frank Chang, Dhahran (SA); Brett Bouldin, Dhahran (SA); Ikhsan Nugraha, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 140 days.

(21) Appl. No.: 16/038,817

(22) Filed: Jul. 18, 2018

(65) Prior Publication Data

US 2020/0024936 A1 Jan. 23, 2020

(51) Int. Cl.
*E21B 43/26* (2006.01)

(52) U.S. Cl.
CPC ..... *E21B 43/26* (2013.01)

(58) Field of Classification Search
CPC ..... E21B 43/26
USPC ..... 166/308.1
See application file for complete search history.

(56) References Cited

U.S. PATENT DOCUMENTS 3,211,221 A 10/1965 Huitt
5,279,370 A 1/1994 Brandell et al.
5,947,200 A 9/1999 Montgomery
6,006,838 A 12/1999 Whiteley et al.
7,828,063 B2 * 11/2010 Olsen ..... E21B 43/26 166/308.1
2005/0133226 A1 6/2005 Lehman
2006/0070740 A1 4/2006 Surjaatmadja et al.
2006/0196667 A1 * 9/2006 Alba ..... E21B 33/128 166/308.1
2006/0207765 A1 * 9/2006 Hofman ..... E21B 34/14 166/313
2010/0000727 A1 1/2010 Webb et al.
2010/0243242 A1 9/2010 Boney et al.
2015/0159469 A1 6/2015 Purkis et al.
2015/0218925 A1 8/2015 Lecampion et al.
2015/0376958 A1 12/2015 Ringgenberg
2016/0201440 A1 7/2016 Aidagulov et al.
2017/0254186 A1 * 9/2017 Aidagulov ..... E21B 43/00
2018/0266183 A1 * 9/2018 Ayub ..... E21B 43/26

* cited by examiner

*Primary Examiner* — Matthew R Buck
*Assistant Examiner* — Patrick F Lambe
(74) *Attorney, Agent, or Firm* — Bracewell LLP; Constance Gall Rhebergen

(57) ABSTRACT

A system and method of wellbore operations that forms notches into a subterranean formation that circumscribes a wellbore prior to fracturing the formation. The notches extend past the hoop stress regime that surrounds the wellbore so that fractures formed by fracturing are oriented in a designated plane. In one example, a fluid jet is used to form the notches, and which is discharged from a nozzle that rotates about a downhole tool. The nozzle is set in a sleeve that is rotatable about the downhole tool, and pressurized fluid is delivered to a plenum disposed on an inner surface of the sleeve. The nozzle is oriented oblique to a radius of the sleeve, so that the fluid being discharged from the nozzle generates a force that rotates the sleeve.

20 Claims, 11 Drawing Sheets

PRESSURE SOURCE
CONTROLLER

METHOD OF SUBTERRANEAN FRACTURING

BACKGROUND

1. Field

The present disclosure relates to fracturing in a subterranean formation. More specifically, the disclosure relates to initiating fractures directly in formation set radially outward from a wellbore and past a region of wellbore influenced stress in the formation that circumscribes the wellbore.

2. Related Art

Hydrocarbon producing wellbores extend subsurface, and intersect subterranean formations where hydrocarbons are trapped. Drilling systems are typically used to excavate the wellbores, that include drill bits that are on the end of a drill string, and a drive system above the opening to the wellbore that rotates the drill string and bit. Cutting elements on the drill bit scrape the bottom of the wellbore as the bit is rotated and excavate rock from the formation thereby deepening the wellbore. During drilling operations, drilling fluid is normally pumped down the drill string and discharged from the drill bit into the wellbore. The drilling fluid flows back up the wellbore in an annulus between the drill string and walls of the wellbore. Cuttings produced while excavating are carried up the wellbore with the circulating drilling fluid.

After a well is drilled, fractures are sometimes created in the wall of the wellbore that extend into the formation from the wellbore. The fractures are meant to increase drainage volume from the formation into the wellbore, to in turn increase hydrocarbon production from the formation. Fracturing is typically performed by injecting pressurized fluid into the wellbore. Fracturing initiates when the pressure in the wellbore exerts a force onto the rock that exceeds its strength in the formation. However, orientations of fractures generated in the formation are affected by hoop stresses initiated by wellbore formation, and that are usually present in the formation around the wellbore. The hoop stresses typically cause the fractures to extend along the length of the wellbore, even if the wellbore is drilled in the direction of minimum stress in the formation. Such longitudinal fractures sometimes extend into adjacent subterranean zones, which is especially undesirable when the zones are at different pressures and where cross flow is possible. Further, although the fracture orientation may rotate into an orientation perpendicular to the direction of minimum stress when radially past the wellbore generated hoop stresses, this can cause a pinch-out in the fracture path to increase possible pre-matured screen-out during fracturing treatment and introduce flow restriction to hydrocarbons flowing through the fracture.

SUMMARY

A system for operations in a wellbore is disclosed, which in one example includes a pressurized fluid source that communicates pressurized fluid to a bore in an annular mandrel. A nozzle on the mandrel is also in communication with the pressurized fluid, and discharges the pressurized fluid as a fluid jet; which impacts and cuts a notch into a sidewall of the wellbore. Rotating the mandrel cuts along a path that circumscribes the sidewall. A fracturing system is coupled with the mandrel, and that is put in a closed configuration that keeps the pressurized fluid in the fracturing system. Putting the fracturing system in an open configuration releases the pressurized fluid from the fracturing system. In an example, the nozzle is provided in a nozzle sleeve that mounts around a section of the mandrel. A passage in the nozzle is angled, which causes the sleeve to rotate when pressurized fluid flows through the passage. Rotating the sleeve directs the jet along the circular path around the sidewall of the wellbore. The notch can extend radially past hoop stresses that were generated when forming the wellbore. Optionally, an annular nozzle valve member is included which selectively allows or blocks flow through the nozzle. The pressurized fluid can be adjusted to different pressures for cutting into the sidewall, and for fracturing. The pressure for fracturing is optionally at a value designated to fracture subterranean formation intersected by the notch. An annular housing can be included that has a groove circumscribing its inner surface, where a split ring is in the groove. In this example an annular anchor sleeve is in the housing which is in selective communication with the pressurized fluid. A lip on an end of the anchor sleeve retains the ring in the groove. The fracturing system can be opened by using pressurized fluid to move the lip axially away from the ring. An optional annular valve sleeve in the housing and is adjacent an opening in a sidewall of the housing when the fracturing system is in the closed configuration, and spaced away from the opening when the fracturing system is in the open configuration. An end of the valve sleeve can abut the split ring, so that moving the anchor sleeve and lip away from the split ring releases the split ring from the groove, and the valve sleeve is moveable past the groove and away from the opening. The system can include a packer that is inflatable with pressurized fluid via a flow circuit. Moving the valve sleeve selectively allows pressurized fluid to fill the packer, and also allows flow through the nozzle to form the notch. An alternate embodiment has a plurality of nozzle bodies each with passages that are profiled so that jets from adjacent nozzle bodies are substantially proximate one another. Different embodiments exist where the pressurized fluid includes a compound that is corrosive to a subterranean formation circumscribing the wellbore, and where the nozzles are formed from a material that is dissolvable when exposed to the compound.

Also disclosed is a method of wellbore operations that includes discharging pressurized fluid from a downhole to form a notch along an inner surface of the wellbore, where the notch extends past a stress case around the wellbore. The subterranean formation is fractured by discharging additional pressurized fluid from the string that contacts the notch. The fluid is alternatively discharged from the string through a nozzle, in this example the method can further involve rotating the nozzle about an axis of the string, and where the fluid is discharged oblique to an axis of the string. The fluid can have a corrosive compound that dissolves the nozzle and which forms an opening; additional fluid can then be directed through the opening. In an embodiment, a ball and ball seat, along with fluid pressure, are used to a sleeve valve discharges the fluid from the string. A packer can also be on the string, which is inflated by moving a valve sleeve out of the way so that fluid can fill the packer.

BRIEF DESCRIPTION OF DRAWINGS

Some of the features and benefits of that in the present disclosure having been stated, and others will become apparent as the description proceeds when taken in conjunction with the accompanying drawings, in which.

DETAILED DESCRIPTION

Figures 1, 2C:
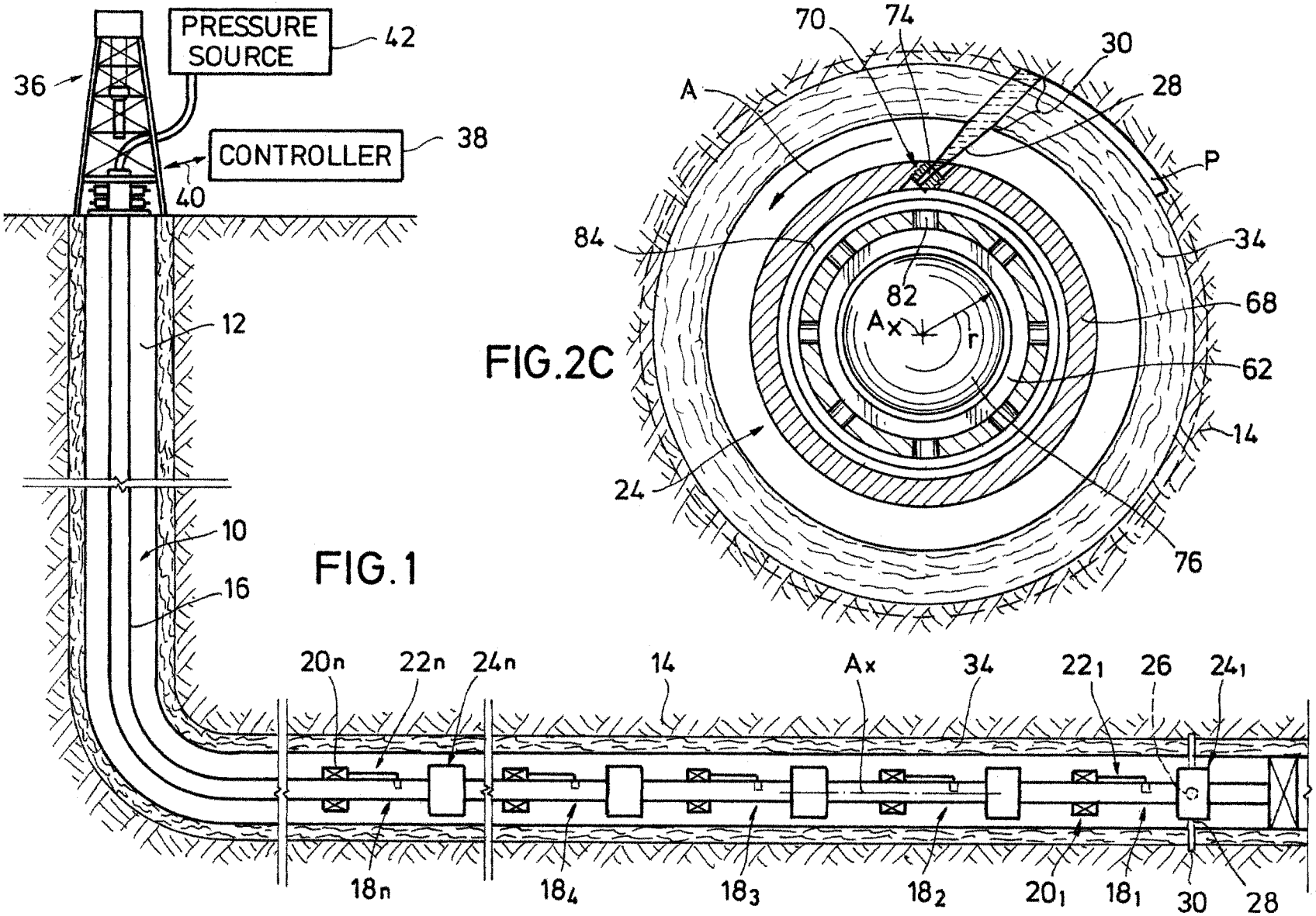
FIG. 1 is a partial sectional view of an example of a fracturing string in a wellbore.
FIG. 2C is an axial sectional view of the jetting device of FIG. 2B and taken along lines 2C-2C.

The method and system of the present disclosure will now be described more fully after with reference to the accompanying drawings in which embodiments are shown. The method and system of the present disclosure may be in many different forms and should not be construed as limited to the illustrated embodiments set forth; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description.

It is to be further understood that the scope of the present disclosure is not limited to the exact details of construction, operation, materials, or embodiments shown and described. Modifications and equivalents will be apparent to one skilled in the art. Illustrative examples have been disclosed in the drawings and specification. Although specific terms are employed, they are used in a generic and descriptive sense only and not for the purpose of limitation.

Shown in a side sectional view in FIG. 1 is one example of a fracturing string 10 disposed in a wellbore 12 that is circumscribed by a formation 14. In the illustrated example, the string 10 is made up of a length of tubing 16 with fracturing assemblies $\mathbf{18}_{1\text{-}n}$ (where "1-n" means "1 to n" such as "1, 2, 3, . . . n) disposed at different axial locations along the tubing 16. In this embodiment each of the fracturing assemblies $\mathbf{18}_{1\text{-}n}$ include a packer $\mathbf{20}_{1\text{-}n}$, each of which are shown in a retracted configuration and spaced away from a wall of wellbore 12. In this configuration, fluid is flowable between string 10 and wall of wellbore 12. Further included with assemblies $\mathbf{18}_{1\text{-}n}$ are packer inflator systems $\mathbf{22}_{1\text{-}n}$ that selectively provide inflation for the packers $\mathbf{20}_1$-n. Jetting devices $\mathbf{24}_{1\text{-}n}$ are also included in each of the assemblies $\mathbf{18}_{1\text{-}n}$, and which in one example are activated by inserting a ball 26 within string 10 at the surface. Ball 26 is depicted in FIG. 1 having landed in jetting device $\mathbf{24}_1$ and string 10 is being pressurized, which generates a fluid jet 28 shown being discharged radially from jetting device $\mathbf{24}_1$. Fluid jet 28 is rotated about an axis $A_x$ of string 10 to form a ring like notch 30 in the formation 14 that circumscribes the jetting device 24. In this example, the fluid jet 28 is discharged from the jetting device $\mathbf{24}_1$ with sufficient velocity to project radially outward into contact with a wall of wellbore 12.

Illustrated in the example of the formation 14 of FIG. 1 is a region where hoop stresses are generated in the formation 12 by excavating the wellbore 12, and which is alternatively referred to as a hoop stress regime 34. The hoop stress regime 34 surround wellbore 12 and extends a distance radially outward from axis $A_x$ and into formation 14. A surface rig 36 is illustrated on the surface, which in one example is provided for operations downhole in the wellbore 12. Further schematically illustrated is one example of a controller 38 that is optionally included for monitoring during wellbore operations, providing commands during wellbore operations, or both. Controller 38 is in selective communication with devices within wellbore, such as those disposed within string 10, and a communication means 40 is shown that provides communication between controller 38 and string 10. Example communication means include electrically conducting media, fiber optics, and wireless, such as electromagnetic waves and/or acoustic pulses. An example of a pressure source 42 is shown in pressure communication with control hardware on the surface and which provides a pressurized fluid, at more than one designated pressure, to the fracturing string 10. Examples of a pressure source 42 include a pump (reciprocating or centrifugal), a pressurized vessel, and a pipeline.

Figure 2A:
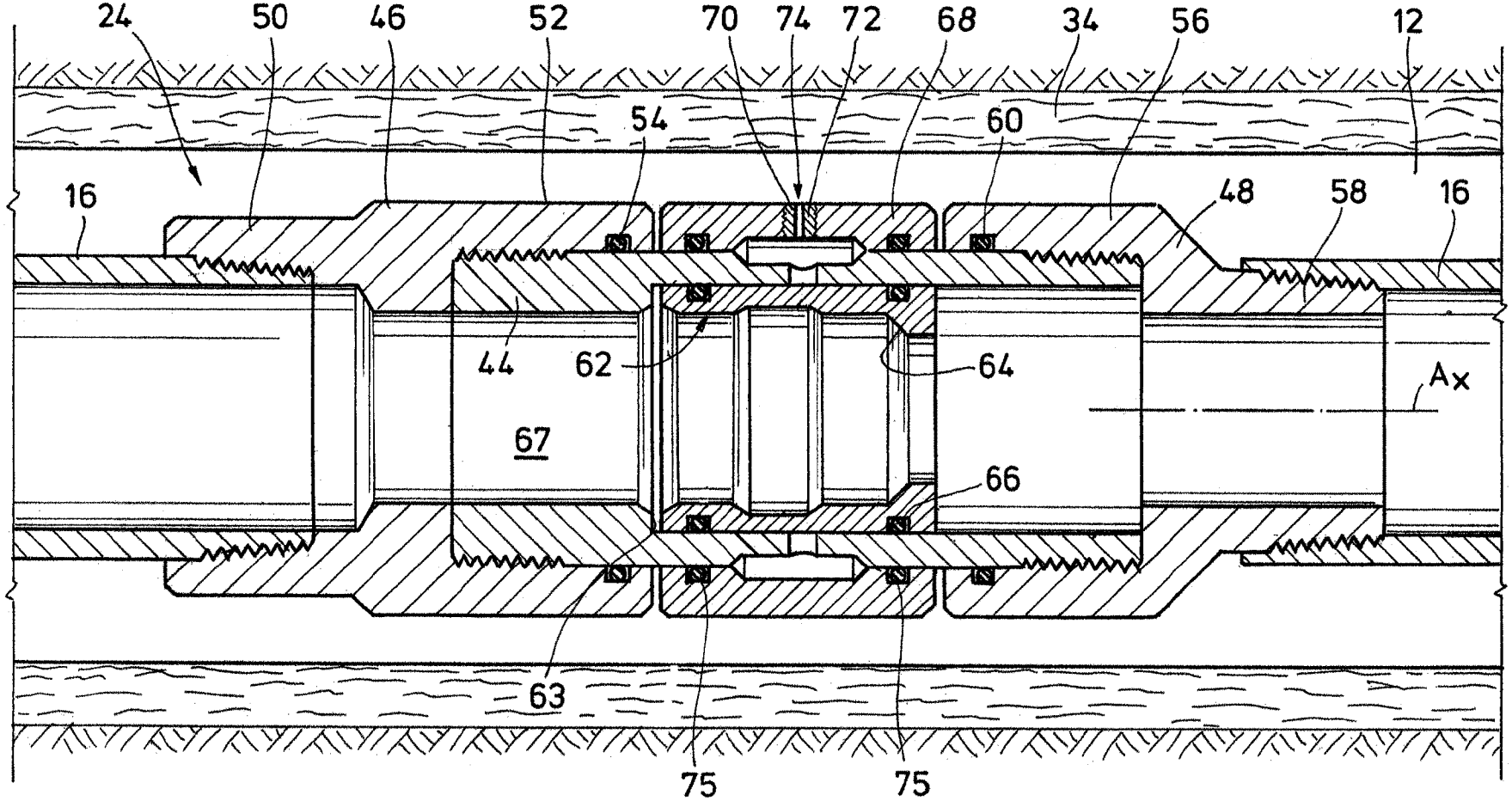
FIG. 2A is a side sectional view of an embodiment of a jetting device for use with the fracturing string of FIG. 1.

An example of a jetting device 24 is shown in a side sectional view in FIG. 2A and which in this example includes an annular mandrel 44 coupled to tubing 16 with annular upstream and downstream connectors 46, 48. In this example, upstream connector 46 includes forward end 50 shown having a box-type connection with threads that match threads on an outer surface of an end of tubing 16. Upstream connector 46 further includes an aft end 52 distal from forward end 50, which also includes a box-type connection and that receives a threaded end of mandrel 44. An O-ring 54 is shown in a recess on an inner surface of upstream connector 46, and which provides an axial seal in the interface between an outer surface of mandrel 44 and inner surface of upstream connector 46. Downstream connector 48 also includes a forward end 56 and aft end 58, where forward end 56 is shown as a box-type connector and which receives a threaded end of mandrel 44 that is distal from upstream connector 46. Aft end 58 of downstream connector 48 is depicted as being a pin-type connector with threads on an outer surface, and which inserts into a threaded connection on a length of tubing 16 that is downstream from the illustrated example of jetting device 24. O-ring 60 is illustrated disposed in a recess formed on an inner surface of downstream connector 48, and which in one example defines an axial pressure barrier between mandrel 44 and downstream connector 48.

Further shown in the example of FIG. 2A is a sleeve-like nozzle valve member 62 that is disposed axially within mandrel 44. An inner radius of mandrel 44 changes abruptly to define a downstream facing shoulder 63. Shoulder 63 interferes with movement of nozzle valve member 62 towards upstream connector 46. An axial end of nozzle valve member 62 distal from shoulder 63 has an inner radius that is profiled inward and oblique with axis $A_x$, and which defines a ball seat 64. O-rings 66 are shown provided in recesses formed on the outer surface of nozzle valve member 62, and which form pressure barriers axially between the nozzle valve member 62 and inner surface of mandrel 44. An axial bore 67 is shown within the example of jetting device 24, and that is in communication with the inside of tubing 16. Also provided in this embodiment of the jetting device 24 is an example of an annular nozzle sleeve 68 disposed in an axial space between the upstream and downstream connectors 46, 48, respectively, and which is rotatable about mandrel 44. Included with the illustrated example of the nozzle sleeve 68 is a nozzle 70 shown formed radially through a sidewall of nozzle sleeve 68. Nozzle 70 in this example includes a cylindrically shaped body 72 and a passage 74 radially intersecting body 72. O-rings 75 are shown in recesses formed along an inner surface of nozzle sleeve 68 and which provide axial pressure barriers between nozzle sleeve 68 and mandrel 44.

Figure 2B:
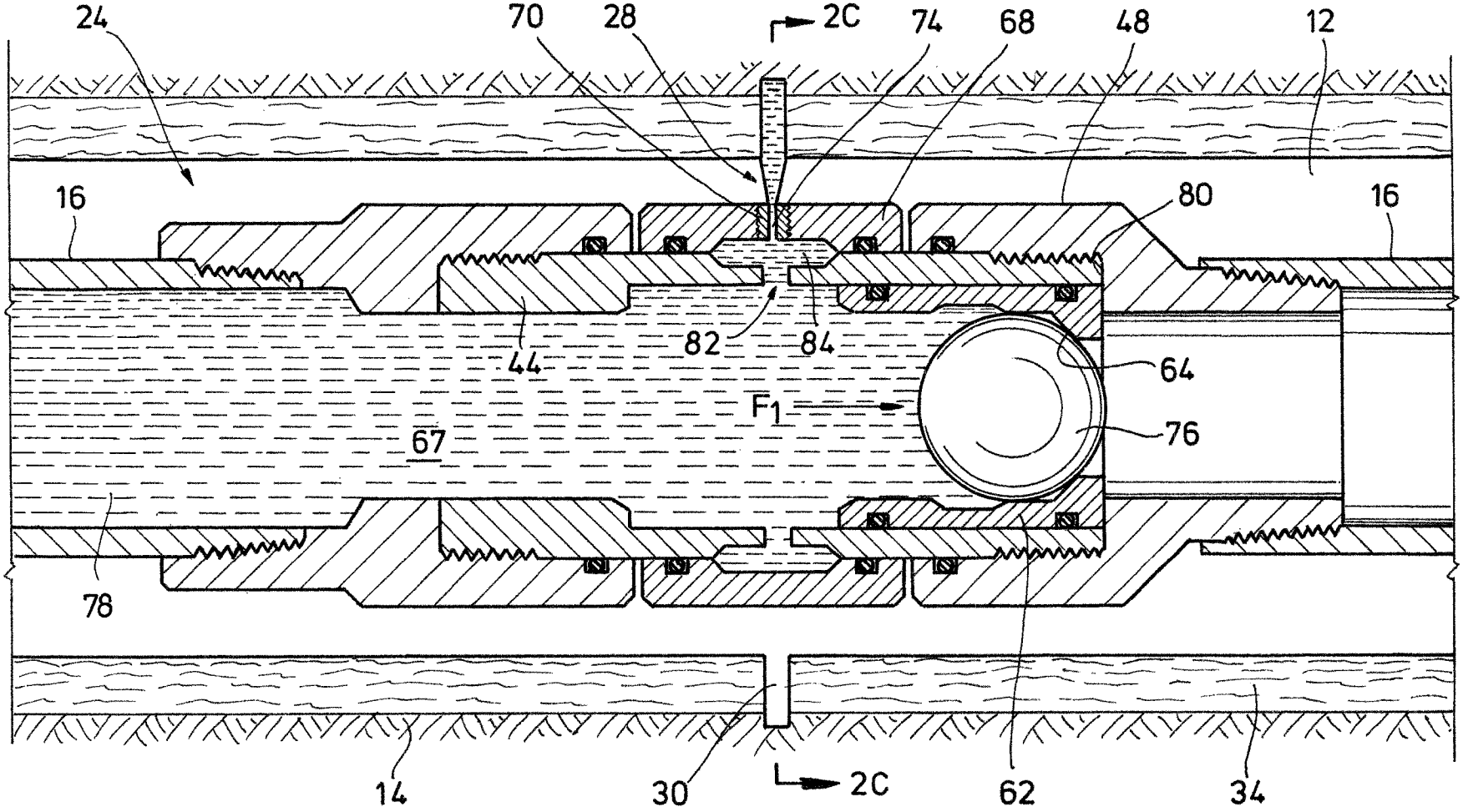
FIG. 2B is a side section view of an example of the jetting device of FIG. 2A forming a notch in a wellbore.

As discussed previously, activation of the jetting device 24 in one example includes inserting a ball within string 10 which in one example is sized to land in a designated one of the jetting devices $\mathbf{24}_{1-n}$ (FIG. 1). In the example of FIG. 2B, a ball 76 is landed in ball seat 64, and pressurized fluid 78, such as from pressure source 42, is applied to an upstream side of ball 76. The applied pressure of this example creates a pressure differential across ball 76 that exerts a force $F_1$ on ball 76 and in the direction shown. Force $F_1$ urges ball 76 and nozzle valve member 62 from its position of FIG. 2A (with nozzle valve member 62 abutting shoulder 63), to that of FIG. 2B where a downstream end of valve member 62 abuts a shoulder 80. Shoulder 80 is defined where an inner radius of downstream connector 48 abruptly changes to form a radial surface. Positioning nozzle valve member 62 to its location of FIG. 2B spaces nozzle valve member 62 away from a port 82 that is formed radially through a sidewall of mandrel 44, thereby opening port 82. Opening port 82 provides pressure communication between bore 67 and a plenum 84 shown defined by a radial and axial space between mandrel 44 and nozzle sleeve 68. In the example of FIG. 2B, inlet to passage 74 is in communication with plenum 84, thus opening port 82 provides communication between bore 67 and passage 74. Accordingly, in a non-limiting example, providing fluid 78 in plenum 84 at a pressure greater than that within wellbore 12 generates a fluid jet 28 shown being discharged from an exit of passage 74. It is believed it is within the capabilities of one skilled in the art to provide the pressurized fluid 78 at a designated pressure that generates a fluid jet 28 of sufficient kinetic energy to create the notch 30 in the formation 14, and of a distance that projects radially past the hoop stress regime 34.

Referring now to FIG. 2C, depicted is an axial view of an example of jetting device 24 during operation and taken along lines 2C-2C of FIG. 2B. Shown here is that nozzle 70 is oriented within nozzle sleeve 68 so that passage 74 is angled oblique to a radius r of the jetting device 24. The oblique orientation of nozzle 70 with respect to radius r in turn generates a fluid jet 28 that is also at an oblique angle to radius r. Redirecting the fluid at the oblique angles generates a tangential force onto the nozzle sleeve 68, thereby rotating nozzle sleeve 68 in an example direction illustrated by arrow A. The combination of the fluid jet 28 having sufficient kinetic energy to form a notch 34 having a distance into the formation 14 exceeding that of the hoop stress regime 34, and the oblique orientation of nozzle 70, generates an annular notch 30 in the formation 14 along a path P circumscribing the mandrel 44, and which extends radially past the hoop stress regime 34.

Figure 3A:
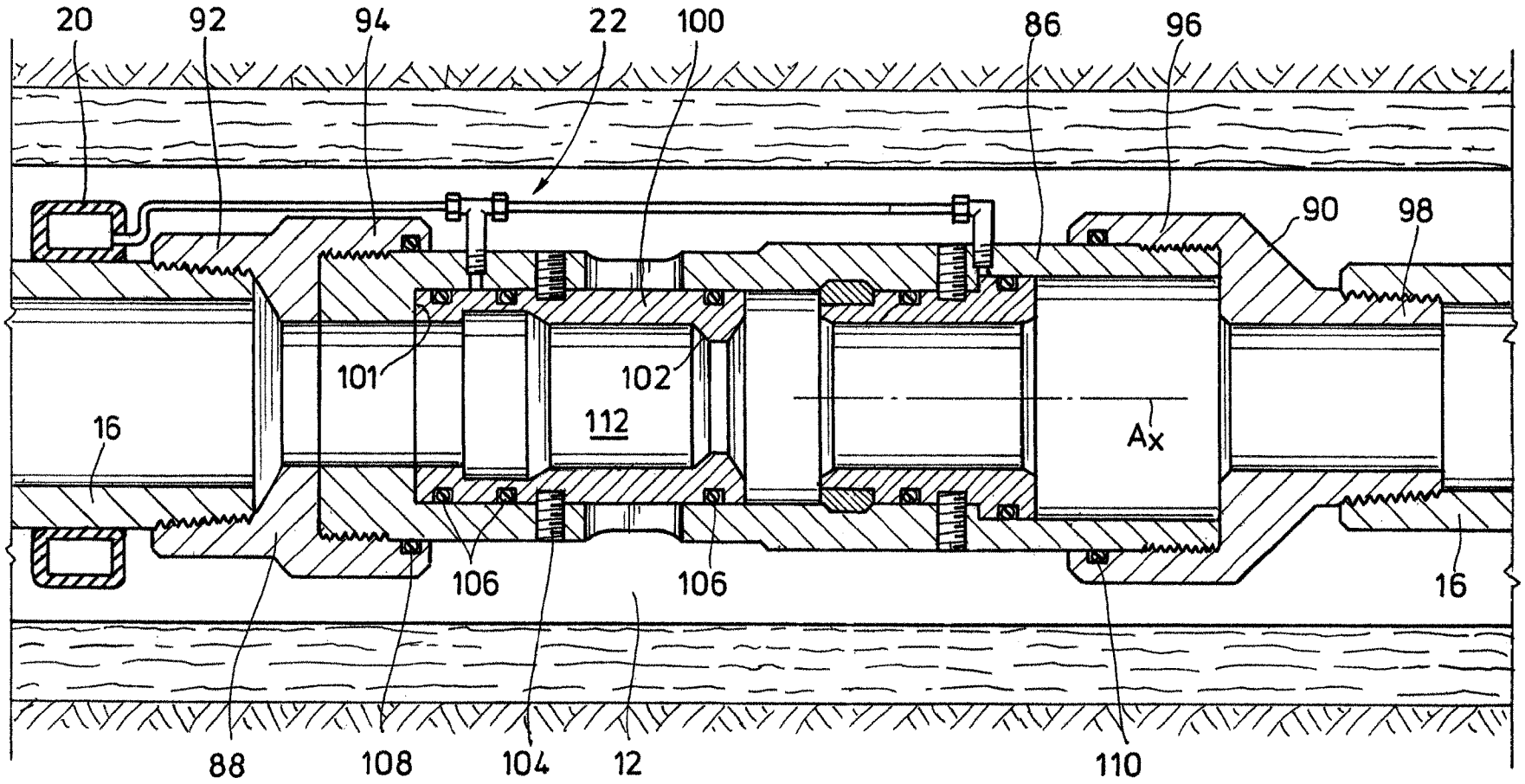
FIG. 3A is a side sectional view of an example of a packer inflator system and a fracturing system for use with the fracturing string of FIG. 1.

Shown in a side sectional view in FIG. 3A is one example of the packer inflator system 22 of FIG. 1. System 22 includes an annular housing 86 that couples to tubing 16 on its upstream end with an upstream connector 88, and to tubing 16 on its downstream end with a downstream connector 90. A forward end 92 on upstream connector 88 has a box-type configuration with threads receive a threaded end of tubing 16. An aft end 94 of connector 88 also is a box-type fitting and has an inner surface that is threaded to receive a threaded end of housing 86. A forward end 96 of downstream connector 90 has a box-type configuration and an inner surface with threads configured to receive a downstream end of housing 86. Aft end 98 of downstream connector 90 is depicted as having a pin-type configuration with threads on outer surface that insert into a threaded end of tubing 16. An annular valve sleeve 100 is shown disposed generally coaxially within housing 86, and having an upstream end abutting a shoulder 101 formed where an inner radius of housing 86 changes abruptly to define a radial surface. Shoulder 101 interferes with movement of valve sleeve 100 upstream. An inner radius of valve sleeve 100 distal from upstream connector 88 changes along an axial distance to form a surface oblique to axis $A_x$, and which defines a ball seat 102. Valve sleeve 100 in this example is shown secured within housing 86 by a shear pin 104 that is inserted into radial bores in an inner surface of housing 86 and outer surface of valve sleeve 100 that are in registration with one another. Optional O-rings 106, 108, 110 are illustrated in grooves, and which define axial pressure barriers. O-rings 106 are depicted formed into an outer surface of valve sleeve 100, O-ring 108 is portrayed in a groove in an inner surface of the aft end 94 of upstream connector 88, and O-ring 110 is displayed in a recess on an inner surface of the forward end 96 of downstream connector 90. An elongated chamber 112 is defined by open space within packer inflator system 22, and which extends generally parallel with axis $A_x$.

Figure 3B:
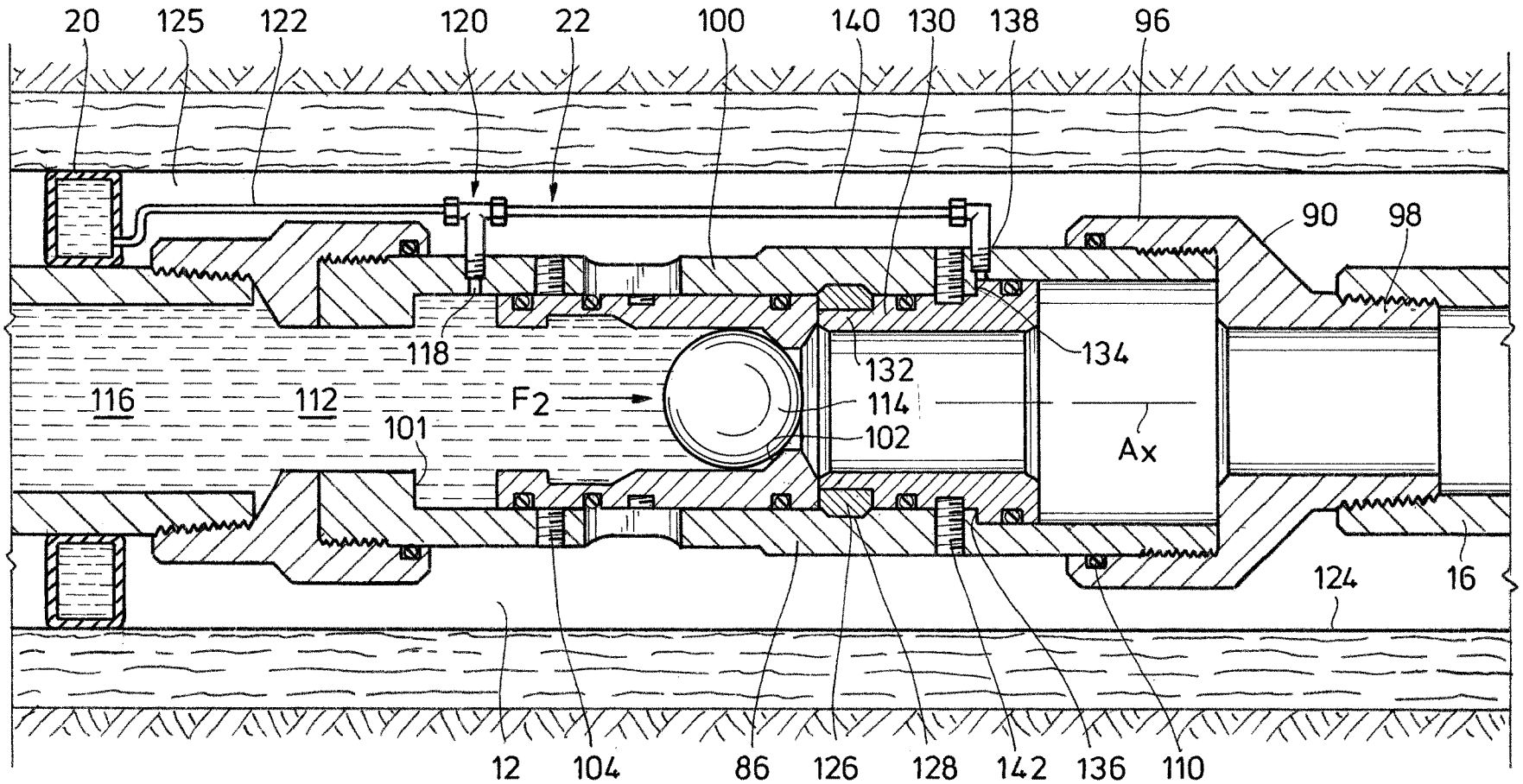
FIG. 3B is a side sectional view of an example of operation of the packer inflator system of FIG. 3A.

Illustrated in a partial side sectional view in FIG. 3B is a non-limiting example of inflating packer 20. Here, ball 114 having a diameter corresponding to ball seat 102 is inserted within string 10 and lands within ball seat 102. In this example, fluid 116 is provided inside of chamber 112, such as by pressure source 42 (FIG. 1). The pressure of fluid 116 causes a pressure differential across the upstream and downstream surfaces of ball 114 that results in a force $F_2$ on ball 114. Force $F_2$ is transferred to shear pin 104 via ball seat 102 and valve sleeve 100, and which exerts a stress on shear pin 104. Shear pin 104 fails when the resulting stress exceeds its yield strength, which releases valve sleeve 100 from housing 86. Force $F_2$ remains applied to ball 114, and moves ball 114 and unmoored valve sleeve 100 from their position of FIG. 3A against shoulder 101. Repositioning valve sleeve 100 as shown also spaces it away from a port 118 shown formed radially through a sidewall of housing 86, which puts chamber 112 and port 118 into communication. An example of a T-fitting 120 having multiple legs is shown mounted on an outer surface of housing 86, and where one leg is in communication with port 118. Another leg of T-fitting 120 is shown coupled with an end of a flowline 122, a distal end of flowline 122 connects to packer 20. Thus in the illustrated example, moving valve sleeve 100 away from port 118 puts flowline 122 in communication with pressurized fluid 116 in chamber 112 via port. In an alternative, packer 20 is inflated by providing fluid 116 in chamber 112 at a pressure so that fluid 116 flows from chamber 112, through port 118 and flowline 122 and into packer 120 to inflate packer 120. In the illustrated example, inflating packer 20 projects packer 20 into sealing contact with sidewall 124 of wellbore 12 to create an axial pressure barrier within an annulus 125 between tool 10 and sidewall 124. It is believed it is within the capabilities of one skilled in the art to provide the pressurized fluid 116 at a designated pressure that inflates the packer 20 to form an axial pressure barrier in annulus 125.

Further illustrated in the example of FIG. 3B is a split C-ring 126 disposed in a recess 128 that circumscribes an inner surface of housing 86. In this example the recess 128 is strategically located so C-ring 126 interferes with axial movement of the valve sleeve 100 downstream after the valve sleeve 100 is moved axially away from port 118. The interference occurs before valve sleeve 100 comes into contact with an anchor sleeve 130, which is shown downstream of recess 128. Anchor sleeve 130 of this embodiment is an annular member having a lip 132 that projects axially upstream and which is set radially inward from an inner surface of C-ring 126. In this example lip 132 retains C-ring 126 in the recess 128. An outer radius of anchor sleeve 130 abruptly changes and forms a radial surface to define a shoulder 134 shown having a surface facing upstream. An inner surface of housing 86 is correspondingly profiled to define a downstream facing shoulder 136 and which interfaces with shoulder 134. A port 136 is illustrated that extends radially through a sidewall of housing 86 and adjacent the interface between shoulders 134, 136. A flowline 140 is depicted having one end in communication with port 138 and an opposite end connected to one of the legs of the T-fitting 120. Similar to shear pin 104, a shear pin 142 is shown disposed in bores that extend radially within housing 86 and anchor sleeve 130, and which releasably secures anchor sleeve 130 to housing 86 and in the position of FIG. 3B.

Figure 3C:
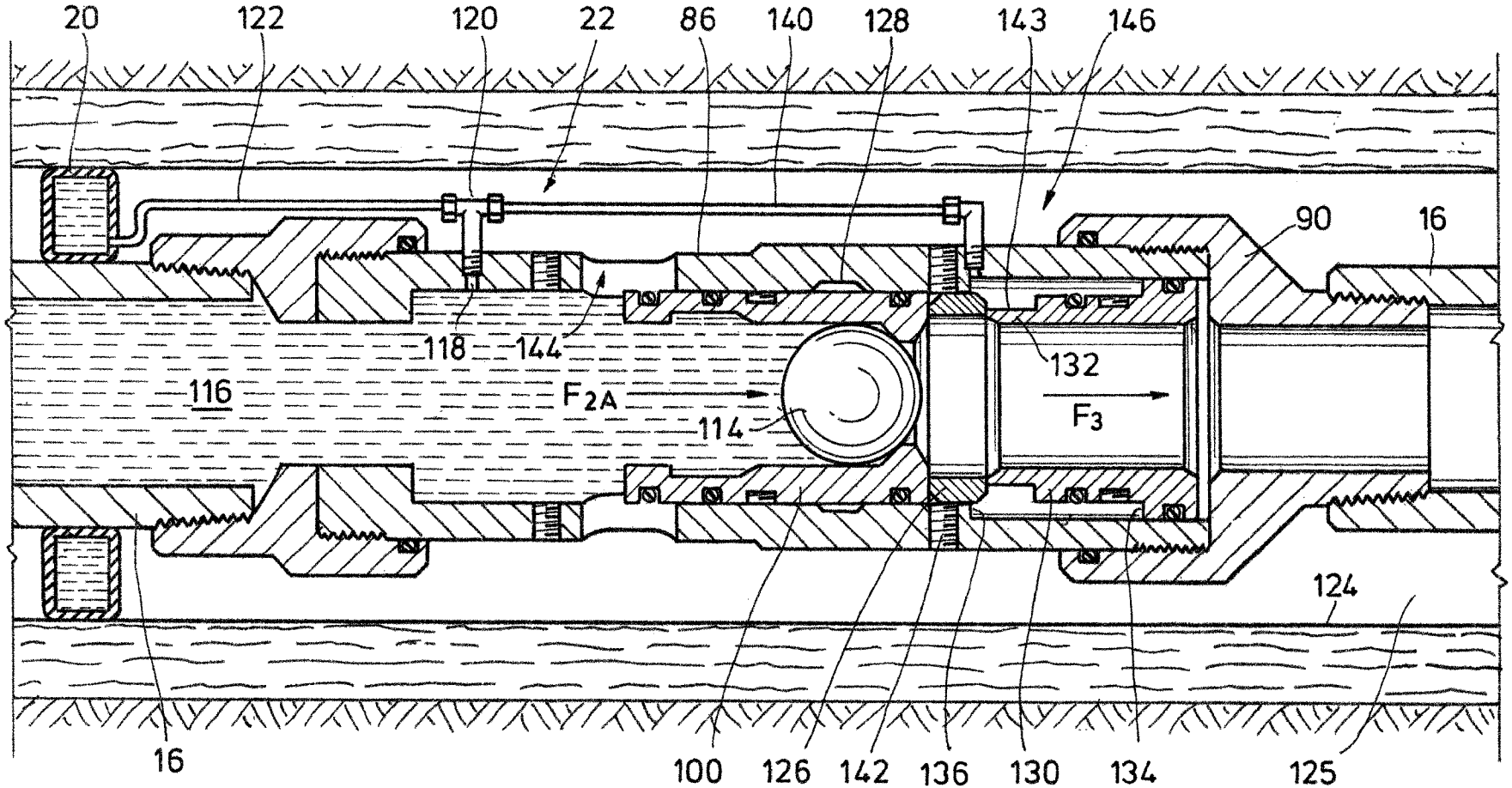
FIGS. 3C and 3D are side sectional views of an example of operation of the fracturing system of FIG. 3A.

Provided in a side partial sectional view in FIG. 3C is a non-limiting example of operations in wellbore 12 where a pressure of fluid 116 is set to a magnitude greater than that which generated force $F_2$ (FIG. 3B). The pressure of fluid 116 is communicated through T-fitting 120 and flowline 140 to the interface between shoulders 134, 136. In the embodiment of FIG. 3C, pressure of fluid 116 results in a pressure differential between shoulder 134 and an end of anchor sleeve 130 proximate downstream connector 90 to generate a force $F_3$ exerted on shoulder 130. In an alternative, force $F_3$ generated by the pressure of fluid 116 is at least at a value to impart a stress onto shear pin 142 that exceeds its yield strength and causes shear pin 142 to fail. Failure of shear pin 142 releases anchor sleeve 130 from housing 86, and continued application of force $F_3$ pushes anchor sleeve 130 axially towards downstream connector 90; and which moves shoulders 134, 136 axially apart to define an annularly shaped cylinder 143. Repositioning anchor sleeve 130 downstream also moves lip 132 away from C-ring 126 to remove the outward radial force retaining C-ring 126 in groove 128. Spacing lip 132 away from C-ring 126 allows C-ring 126 to be removed from recess 128, either by resiliency of C-ring 126, or axial movement of valve sleeve 100.

In the example of FIG. 3C, a force $F_{2A}$ is exerted on ball 114 resulting from a pressure differential across the upstream and downstream surfaces of ball 114, where the upstream pressure is equal to pressure of fluid 116. Force $F_{2A}$ has a magnitude greater than force $F_2$, as pressure in fluid 116 in the example of FIG. 3C is greater than in the example of FIG. 3B, and which generates force $F_2$. Moving anchor sleeve 130 away from C-ring 126 removes the force retaining C-ring 126 in recess 128, and force $F_{2A}$ exerted on C-ring 126 by ball 114 via valve sleeve 100 is sufficient to move C-ring 126 from recess 128. Removing the interference from C-ring 126, force $F_{2A}$ is sufficient to move valve sleeve 100 downstream towards downstream connector 90 and spaced away from an opening 144 shown formed radially through a sidewall of housing 86. Opening 144 has a cross-sectional area greater than that of port 118, and is capable of flowing a sufficient quantity of fluid 116 at a designated flowrate and pressure for fracturing formation 14. In one example, the combination of the valve sleeve 100, ball 114, anchor sleeve 130, C-ring 126, port 118, T-fitting 120, and line 140 are collectively referred to as a fracturing system 146. In an alternative, pressure of fluid 116 is controlled by pressure source 42 (FIG. 1).

Figure 3D:
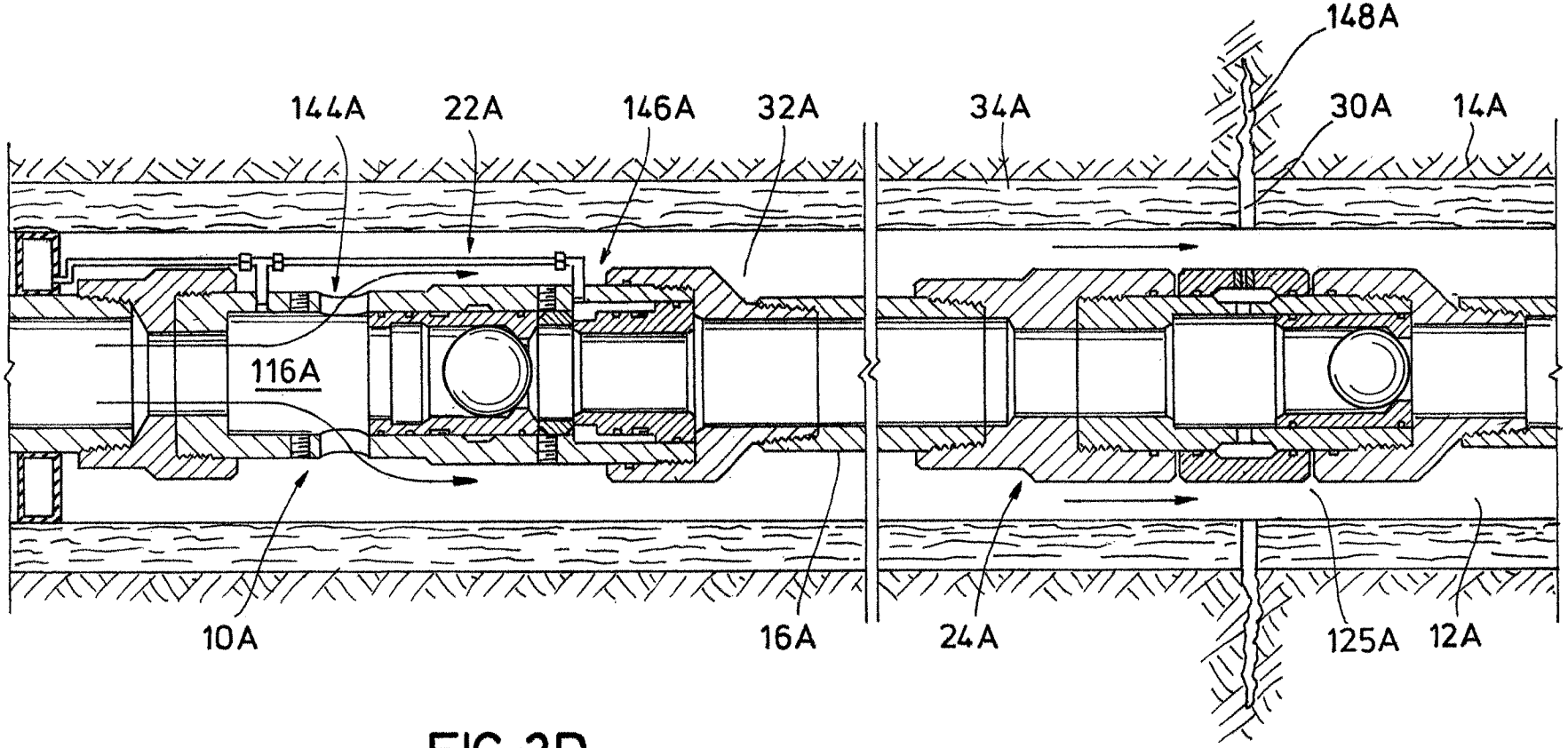

Referring now to FIG. 3D, shown in side sectional view an example of packer inflator system 22A and fracturing system 146A coupled to tubing 16A. An example of a jetting device 24A is also illustrated and coupled to an end of tubing 16A distal from inflator system 22A. An example of a notch 30A is depicted as formed in one example by jetting device 24A. Here, fluid 116A exiting opening 144A and entering annulus 32A flows within annulus 125A between string 10A and wellbore 12A, and adjacent to notch 30A formed by jetting system 24A. As discussed previously, a pressure of fluid 116A is at a pressure designated to exceed a yield strength of formation 14A and thereby formed a fracture 148A that projects radially outward from notch 30A formed through the hoop stress regime 34A within formation 14A.

Figure 4:
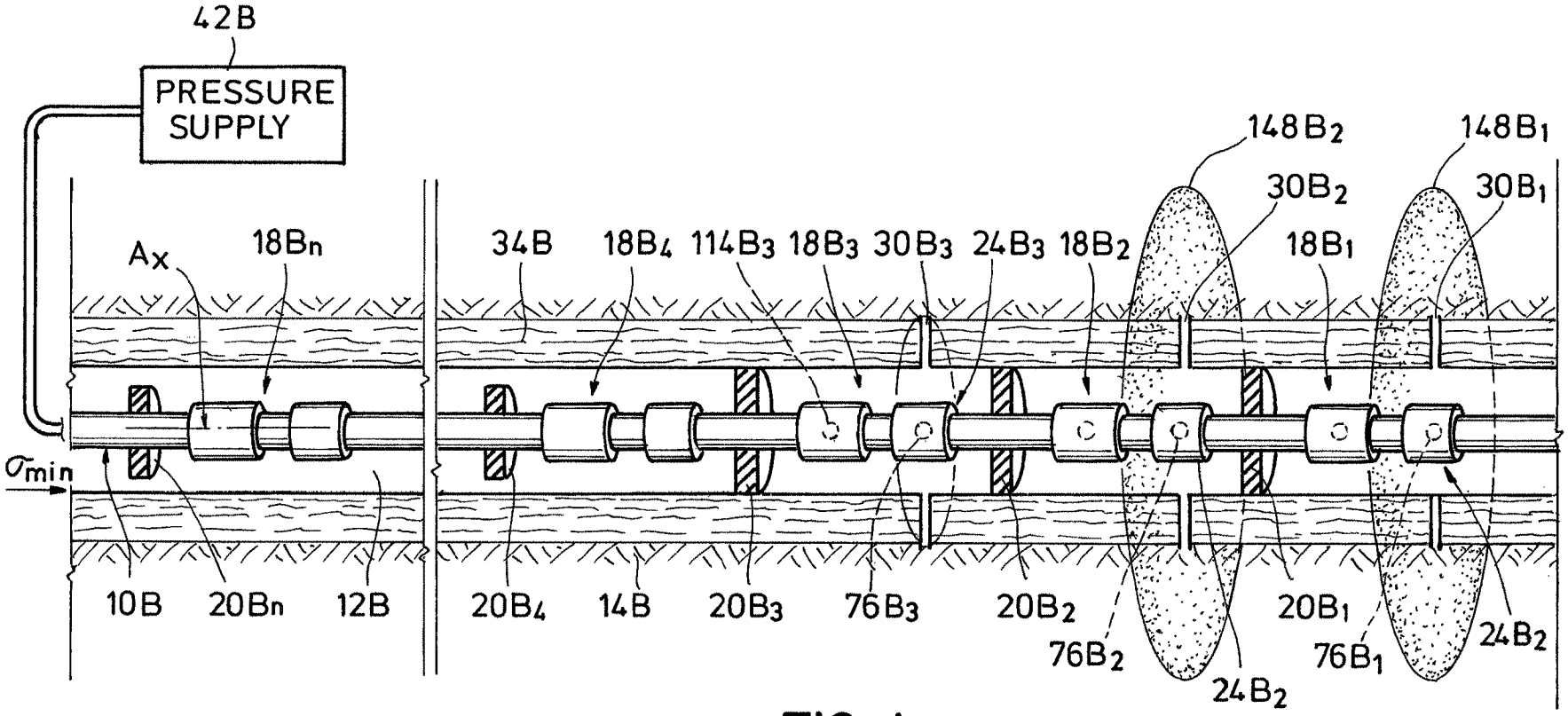
FIG. 4 is a side sectional view of an example of fractures being formed in a subterranean formation.

Illustrated in a sectional perspective view in FIG. 4 is an example of a stage of operation of forming fractures 148$B_{1,2}$ with the tubing string 10B. Here, wellbore 12B is shown formed through the formation 14B along an axis of minimum stress $\sigma_{min}$ and fractures 148$B_{1,2}$ are disposed within planes that are substantially perpendicular with an axis $A_x$ of the wellbore 10B. As discussed previously, the addition of the notches 30$B_1$, 30$B_2$ that project radially past the hoop stress regime 34B prevent the formation of fractures that may project parallel with the axis $A_x$ of wellbore 10B. Further in the example of FIG. 4, the steps previously described for fracturing have taken place in fracturing assemblies 18$B_1$ and 18$B_2$. Pressure source 42B is illustrated in communication with string 10B to selectively provide pressurized fluid for use in the wellbore operations. With regard to the fracturing assembly 18$B_3$, the jetting device 24$B_3$ is being activated to form notch 30$B_3$ within formation 14B. As such, ball 76$B_3$ is shown disposed within string 10B and landed within the jetting device 24$B_3$. Balls 76$B_1$ and 76$B_2$ are illustrated respectively within jetting devices 24$B_1$ and 24$B_2$. Further, ball 114$B_3$ is deployed and packer 20$B_3$ is inflated into contact with sidewalls of wellbore 12B; packers 20$B_1$ and 20$B_2$ are also inflated into contact with wellbore 12B. Balls have not yet been deployed for activating assemblies 18$B_{4-n}$ (where "4-n" means "4 to n" such as "4, 5, 6, . . . n") and corresponding packers 20$B_{4-n}$ are shown in a retracted configuration. In one example of use, the assemblies 18$B_{1-n}$ are actuated in a sequence that begins at the one of the assemblies 18$B_{1-n}$ disposed at the greatest depth in wellbore 12B, and proceeds in order to the one of the assemblies 18$B_{1-n}$ disposed at the most shallow depth in wellbore 12B.

Figure 5A:
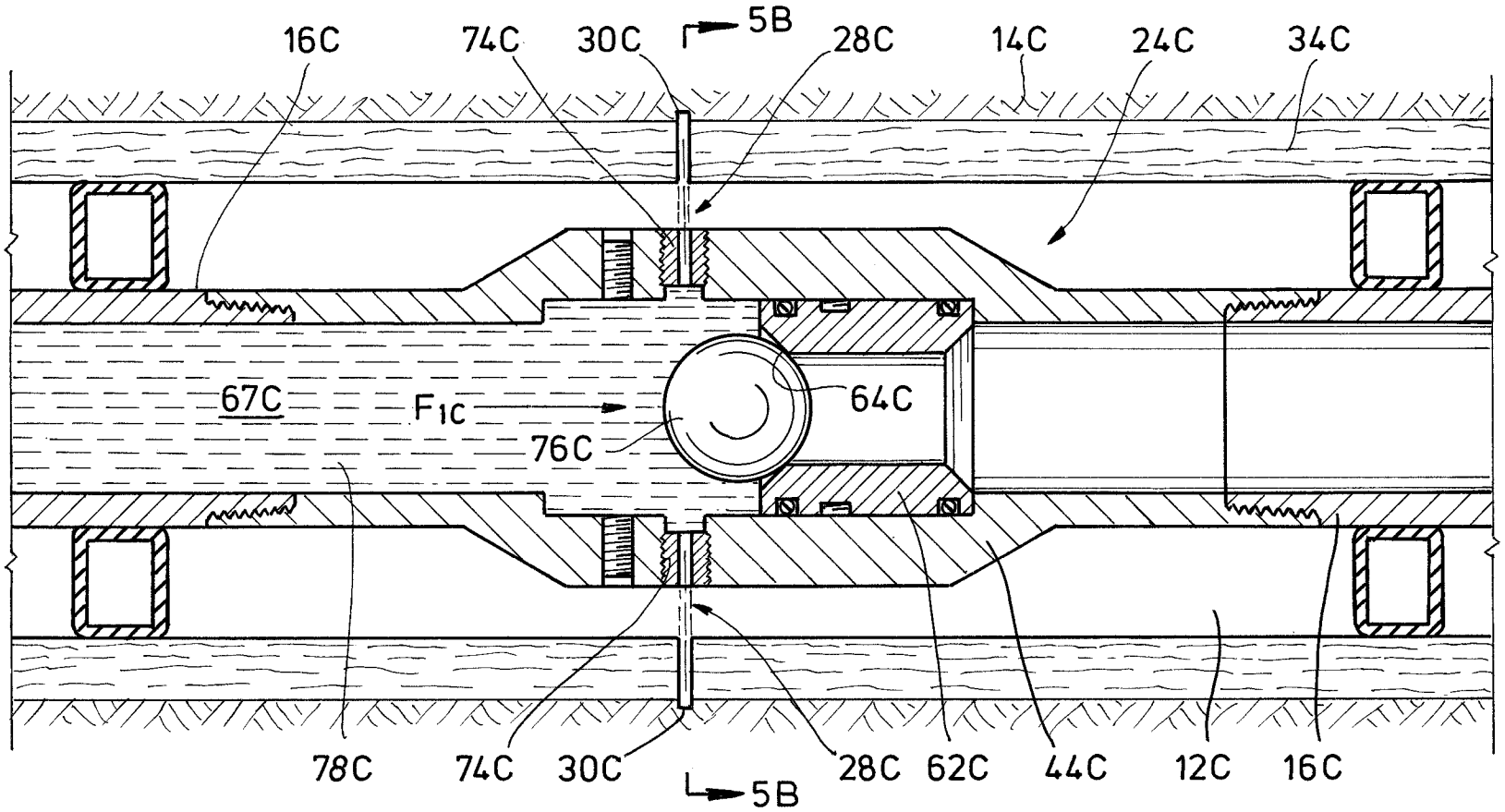
FIG. 5A is a side sectional view of an alternate embodiment of a jetting device for use with the fracturing string of FIG. 1.

Provided in FIGS. 5A through 5D are alternative examples of a jetting device 24C for use in forming a notch 30C in formation 14C, and which is shown extending past hoop stress regime 34C that surrounds wellbore 12C. As depicted in a side sectional view in FIG. 5A is an example of jetting device 24C where an annular mandrel 44C attaches directly to tubing 16C on its upstream and downstream ends. In this example, a ball 76C is illustrated landed on valve seat 64C of valve member 62C. In a manner similar to that described previously, exerting a force Fic on ball 76C, which results from a pressure differential generated by pressurized fluid 78C in bore 67C moves valve member 62C away from passage 74C shown formed radially through mandrel 44C. Passage 74C and bore 67C are put into communication by moving valve member 62C as described so that fluid 78C in bore 67C is flowable through passage 74C. In an alternative, a caustic or corrosive fluid, such as hydrochloric acid, is the fluid 78C being disposed within tubing 16C. Embodiments exist where the notch 30C is formed by dissolving or otherwise chemically breaking down rock in the formation 14C with fluid jets 28C made up of a corrosive fluid.

Figure 5B:
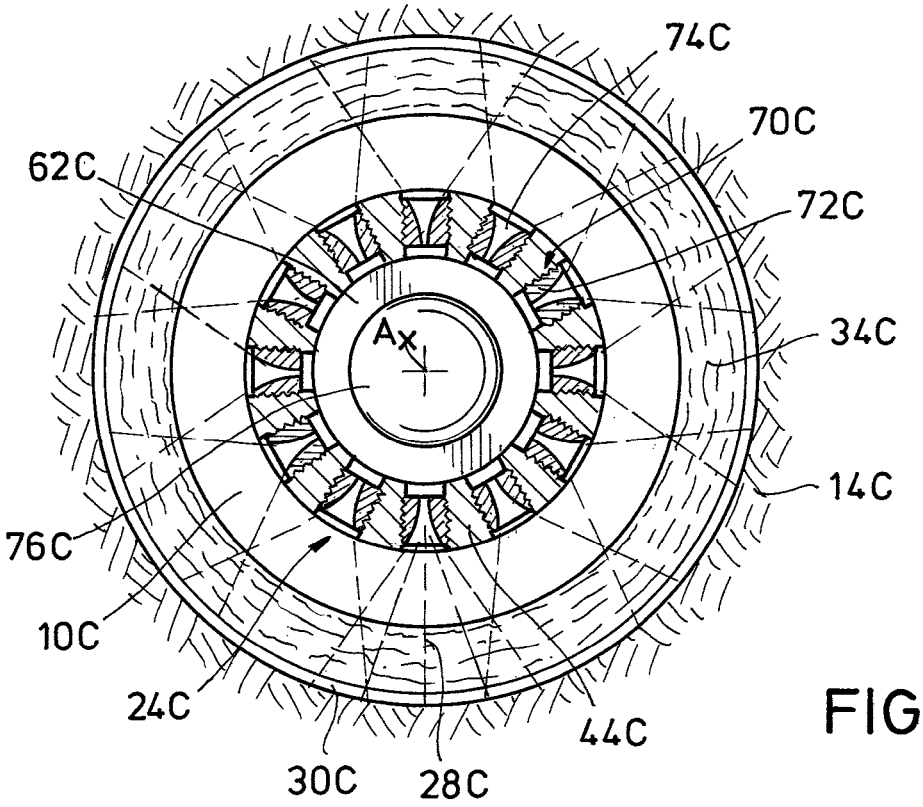
FIG. 5B is an axial sectional view of the jetting device of FIG. 5A and taken along lines 5B-5B.
Figure 5C:
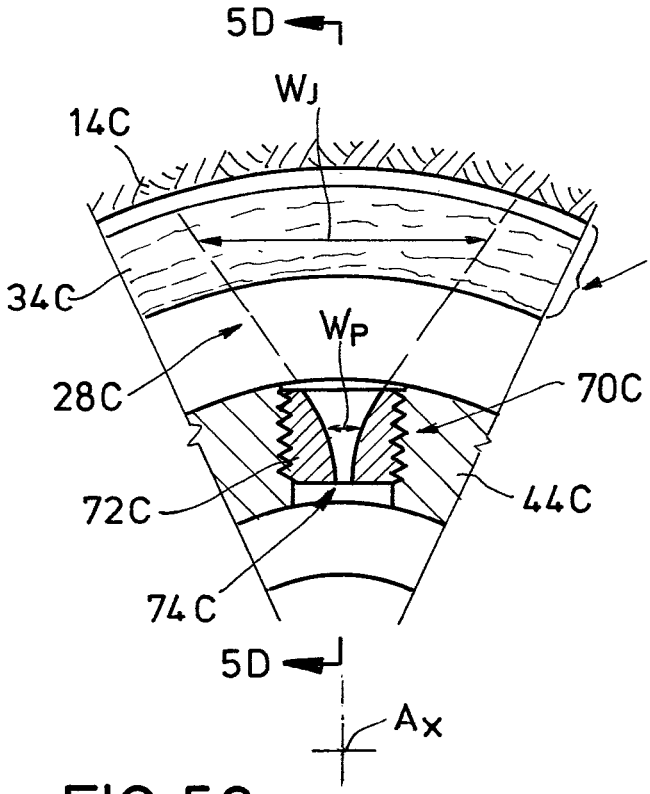
FIG. 5C is an axial sectional view of an example of a nozzle for use with the jetting device of FIG. 5A.
Figure 5D:
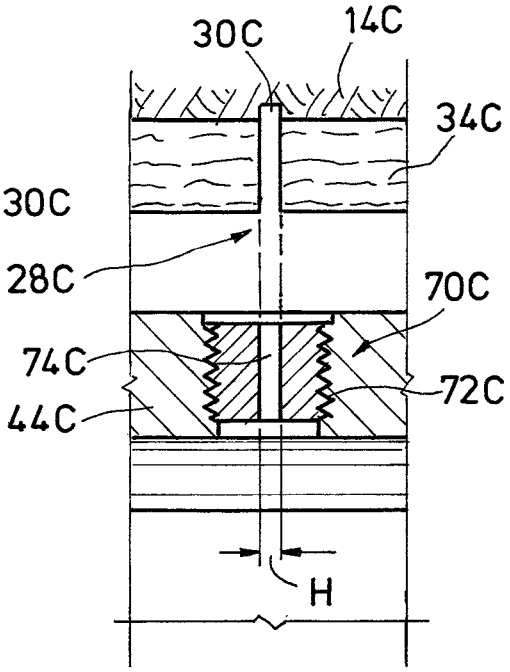
FIG. 5D is a side sectional view of the nozzle of FIG. 5C and taken along lines 5D-5D.

Referring to FIG. 5B, an axial sectional view of jetting device 24C is illustrated, and which is taken along lines 5B-5B of FIG. 5A. In this example, a number of nozzles 70C are shown arranged circumferentially within mandrel 44C and having passages 74C formed within body 72C that project radially outward from an axis $A_x$ of tool 10C. Illustrated in FIGS. 5B and 5C are that the passages 74C of this example have widths WP that orient along a circumference of mandrel 44C, and that increase with distance from axis $A_x$. Shown in FIG. 5D, and taken along lines 5D-5D of FIG. 5C, is an example of a side sectional view of passage 74C having a height H that is substantially uniform along its length. Flaring the width WP of each passage 74C as illustrated in the examples of FIGS. 5A-5E forms fluid jets 28C that each have a fan-like projection and contact a greater percentage of the circumference of the wellbore 12C than would jets formed with a nozzle having a diameter of uniform diameter or width. Further portrayed in the example of FIG. 5C is that the width $W_J$ of jet 28C also increases with distance from axis $A_x$, which is due at least in part to the increasing width WP and the uniform height H of each passage 74C as shown in FIG. 5D. As depicted in FIG. 5B, although passages 74C are angularly offset from one another, fluid jets 28C from those passages 74C intersect with one another a radial distance from mandrel 44C to form a notch 30C that is substantially circular and approximately 360°.

Figure 5E:
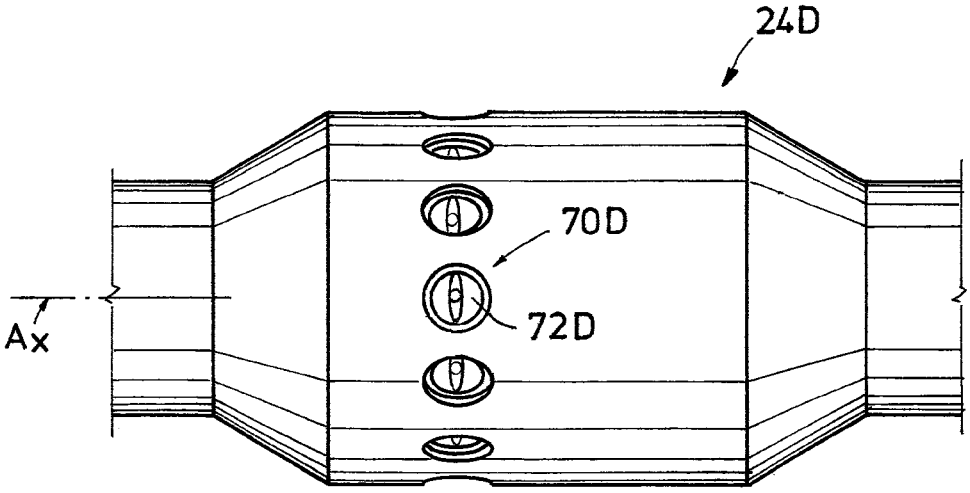
FIGS. 5E and 5F are side views of the jetting device of FIG. 5A before and after removal of nozzle bodies.
Figure 5F:
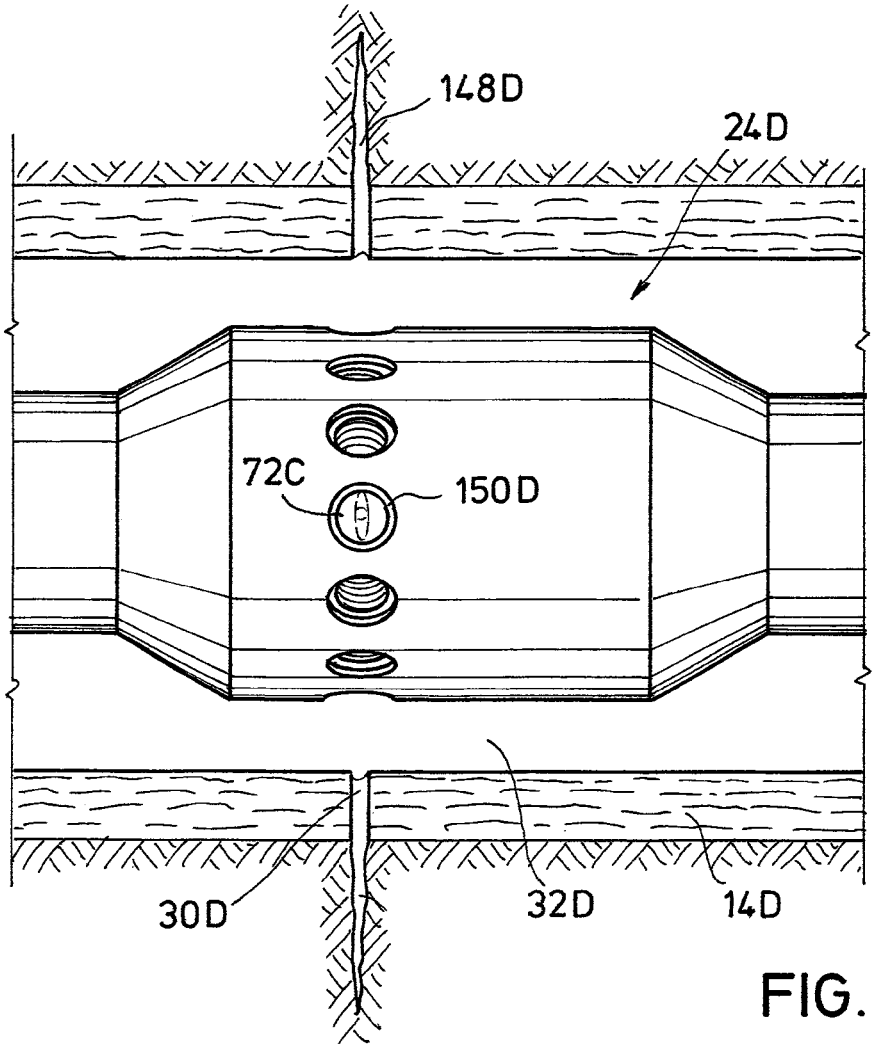

Shown in a side view in FIG. 5E is an alternate embodiment of a jetting device 24D where the nozzles 70D have nozzle bodies 72D that are susceptible to erosion from fluid 78C (FIG. 5A) flowing through the nozzle bodies 72D. Alternatively, the fluid 78C includes a substance (not shown) that removes the nozzle bodies 72D such as by a reaction or erosion. Example substances in the fluid 78C for removing the nozzle bodies 72D include acidic compounds, basic compounds, abrasive particles, and the like, and so that the nozzle bodies 72D are eroded or dissolved over time with exposure to the fluid. Referring now to FIG. 5F, the nozzle bodies 72D (shown in dashed outline) have been eroded away from within the jetting device 24D to form openings 150D that project radially through a sidewall of jetting device 24D and provide communication between inside of jetting device 24D and annulus 32D. In an embodiment, cross-sectional area of openings 150D are adequate to accommodate a flow of fracturing fluid 116A (FIG. 3D) sufficient for generating a fracture 148D within the formation 14D. In a non-limiting example, fracturing fluid 116A is delivered into jetting device 24D, and directed into annulus 32D from openings 150D, at a pressure and volume sufficient to form fracture 148D shown propagating radially outward from notch 30D. In an alternative, fluid 78C used for jetting the notch 30D is the same as that used for generating the fracture 148D.

The present disclosure therefore is well adapted to carry out the objects and attain the ends and advantages mentioned, as well as others inherent. While embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for operations in a wellbore comprising:

a source of pressurized fluid;

an annular mandrel having an axial bore in selective communication with pressurized fluid from the source of pressurized fluid;

a nozzle provided with the mandrel that is in communication with the pressurized fluid, and having a discharge that where pressurized fluid exits the nozzle in the form of a fluid jet that forms a notch in a wall of the wellbore, and the notch circumscribing the wall of the wellbore and the mandrel; and a fracturing system coupled with the mandrel and that is selectively positioned in a closed configuration where the pressurized fluid is retained within the fracturing system and an open configuration where the pressurized fluid is released from the fracturing system.

2. The system of claim 1, further comprising a nozzle sleeve circumscribing the mandrel and that is selectively rotatable about the mandrel, the nozzle comprising, a passage, and wherein the nozzle is mounted in the nozzle sleeve so that the passage is oriented oblique to a radius of the sleeve, and an inlet to the passage that is in selective communication with the axial bore in the mandrel, so that when pressurized fluid is in the axial bore, the pressurized fluid flows through the obliquely oriented passage to generate a rotational force on the sleeve to rotate the sleeve, and the jet of the pressurized fluid discharges from the nozzle and is directed along the circumferential path.

3. The system of claim 2, further comprising an annular nozzle valve member disposed within the mandrel that is selectively slideable from a position adjacent a port that is formed radially through a sidewall of the mandrel, to a position spaced away from the port, where the nozzle valve member blocks communication between the axial bore and the nozzle when adjacent the port, and the axial bore is in communication with the nozzle when the nozzle valve member is spaced away from the port.

4. The system of claim 2, further comprising a tubular coupled with the mandrel, a packer on an outer surface of the tubular, a port formed radially through a sidewall of the mandrel, an opening formed radially through the sidewall and spaced axially away from the port, an annular valve sleeve slideably disposed in the mandrel, an annular anchor sleeve disposed in the mandrel, and a flow circuit that is in communication with the port, the packer, and a pressure surface on the anchor sleeve.

5. The system of claim 4, where the valve sleeve is moveable between a first position that is adjacent the port and the opening, a second position that is spaced away from the port and adjacent the opening, and a third position that is spaced away from the port and away from the opening, and where pressurized fluid is in communication with the packer and with the pressure surface when the valve sleeve is in the second position, and when the valve sleeve is in the third position pressurized fluid is in communication with a notch formed by the jet, where the notch extends into a subterranean formation circumscribing the wellbore a distance past a hoop stress regime that surrounds the wellbore.

6. The system of claim 1, where the notch extends a distance into subterranean formation circumscribing the wellbore and past a hoop stress regime around the wellbore.

7. The system of claim 6, where the pressurized fluid comprises a first pressurized fluid at a first pressure, and when the fracturing system is in the open configuration a second pressurized fluid at a second pressure that is greater than the first pressure is in communication with the notch.

8. The system of claim 7, where the second pressure is at a value designated to fracture subterranean formation intersected by the notch.

9. The system of claim 1, where the nozzle comprises a plurality of nozzle bodies each with passages that are profiled so that jets from adjacent nozzle bodies are substantially proximate one another.

10. The system of claim 1, where the pressurized fluid comprises a compound that is corrosive to a subterranean formation circumscribing the wellbore, and where the nozzles are formed from a material that is dissolvable when exposed to the compound.

11. A system for operations in a wellbore comprising:

a source of pressurized fluid;

an annular mandrel having an axial bore in selective communication with pressurized fluid from the source of the pressurized fluid;

a nozzle provided with the mandrel that is in communication with the pressurized fluid, and having a discharge that where pressurized fluid exits the nozzle in the form of a fluid jet that forms a notch in a wall of the wellbore, and the notch circumscribing the wall of the wellbore and the mandrel; and a fracturing system coupled with the mandrel and that is selectively positioned in a closed configuration where the pressurized fluid is retained within the fracturing system and an open configuration where the pressurized fluid is released from the fracturing system, the fracturing system comprising, an annular housing having a groove circumscribing an inner surface of the housing, a split ring disposed in the groove, and an annular anchor sleeve in the housing having a radial surface in selective communication with the source of pressurized fluid and a lip extending axially from an end of the anchor sleeve that is spaced radially inward from the groove when the fracturing system is in the closed configuration and which retains the ring in the groove.

12. The system of claim 11, where the radial surface is spaced axially away from the lip and radially between the lip and the housing, and where the fracturing system is selectively put into the open configuration by communicating the pressurized fluid at a designated pressure to the radial surface to move the anchor sleeve axially within the housing and to move the lip axially away from the ring to allow the ring to expand and move out of the groove.

13. The system of claim 12, further comprising an annular valve sleeve that is disposed in the housing and that is adjacent an opening formed radially through a sidewall of the housing when the fracturing system is in the closed configuration, and that is spaced axially away from the opening when the fracturing system is in the open configuration.

14. The system of claim 13, where an end of the valve sleeve abuts the split ring, so that when the anchor sleeve is moved axially within the housing and the lip is axially away from the split ring, the split ring is released from the groove and the valve sleeve is moveable past the groove and away from the opening.

15. A method of wellbore operations comprising:

discharging a fluid from a string disposed in the wellbore;

forming a notch with the fluid that circumscribes an inner surface of the wellbore and that projects radially outward into a subterranean formation past a hoop stress regime around the wellbore, where the fluid is discharged from the string through a nozzle that mounts in a sidewall of a nozzle sleeve, where the nozzle has a passage;

providing additional fluid into the string; and fracturing the subterranean formation by directing the additional fluid into the notch.

16. The method of claim 15, where the nozzle is oriented so that the passage is oblique to a radius of the sleeve, the method further comprising rotating the sleeve about an axis of the string by directing the fluid through the nozzle to exert a tangential force onto the nozzle sleeve generated by the fluid passing through the obliquely oriented passage.

17. The method of claim 15, where the fluid comprises a compound that is corrosive to the subterranean formation and to the nozzle so that the nozzle dissolves after the notch is formed to define an opening in a side of the string.

18. The method of claim 15, where the additional fluid is directed through the opening in the side of the string.

19. The method of claim 15, where discharging fluid from the string comprises landing a ball on a ball seat that is disposed in a jetting device in the string, and using pressure to urge the ball axially within the string to open a sleeve valve that couples with the ball seat.

20. The method of claim 15, where a packer is on the string, a port is formed radially through a sidewall of the string and which is in communication with the packer, a valve sleeve is disposed in a first position in the string, and where an opening is formed through the sidewall of the string, the method further comprising landing a ball in the valve sleeve, inflating the packer on the string by moving the valve sleeve to a second position away from the port by urging the ball with pressure, using pressurized fluid to move an anchor sleeve out of interfering contact with the valve sleeve and urging the ball with additional pressure to move the valve sleeve to a third position where the valve sleeve is spaced away from the opening, and where the additional fluid exits the string through the opening.

* * * * *